US010894656B2

(12) United States Patent
Lange et al.

(10) Patent No.: US 10,894,656 B2
(45) Date of Patent: Jan. 19, 2021

(54) STORING AND DISPENSING CONTAINER FOR WIPES

(71) Applicant: Kimberly-Clark Worldwide, Inc., Neenah, WI (US)

(72) Inventors: Scott Richard Lange, Appleton, WI (US); Dylan Lee Wudtke, Appleton, WI (US)

( * ) Notice: Subject to any disclaimer, the term of this patent is extended or adjusted under 35 U.S.C. 154(b) by 0 days.

(21) Appl. No.: 16/348,742

(22) PCT Filed: Nov. 11, 2016

(86) PCT No.: PCT/US2016/061566
§ 371 (c)(1),
(2) Date: May 9, 2019

(87) PCT Pub. No.: WO2018/089013
PCT Pub. Date: May 17, 2018

(65) Prior Publication Data

US 2019/0291942 A1 Sep. 26, 2019

(51) Int. Cl.
*B65D 83/08* (2006.01)
*A47K 10/42* (2006.01)
(Continued)

(52) U.S. Cl.
CPC ..... *B65D 83/0805* (2013.01); *A47K 10/421* (2013.01); *B65D 75/58* (2013.01);
(Continued)

(58) Field of Classification Search
CPC ..... B65D 83/0805; B65D 83/0894; B65D 75/58; A47K 10/421; A47K 2010/3233; A47K 2010/3266
(Continued)

(56) References Cited

U.S. PATENT DOCUMENTS 1,603,714 A * 10/1926 Rappleye ..... A47K 10/44 221/48
1,773,652 A * 8/1930 Traver ..... B65D 83/0805 221/63
(Continued)

FOREIGN PATENT DOCUMENTS

EP 1644261 B1 7/2010
WO 05016768 A2 2/2005
(Continued)

*Primary Examiner* — Rakesh Kumar
(74) *Attorney, Agent, or Firm* — Kimberly-Clark Worldwide, Inc.

(57) ABSTRACT

A storing and dispensing container includes a stack of moist wipes, a film pouch, and a rigid flip top that has a lid connected to a flange by a hinge. The flange is affixed to an outer surface of the pouch and surrounds a dispensing orifice. The flange can assume bent and unbent states. The flange has first and second hinges that each extend along a first bending axis, such than when a top wipe is extracted from the package through the dispensing orifice, the first bending axis is pulled away from the stack, and the flange bends about the first bending axis to assume the bent state. In particular embodiments, the hinges can be defined by areas of reduced flange thickness, reduced flange width, and/or reduced flange rigidity. The flange can include a plurality of strengthening ribs, and hinges can be defined by gaps in the ribs.

14 Claims, 16 Drawing Sheets

(51) Int. Cl.
*B65D 75/58* (2006.01)
*A47K 10/32* (2006.01)

(52) U.S. Cl.
CPC .. *B65D 83/0894* (2013.01); *A47K 2010/3233* (2013.01); *A47K 2010/3266* (2013.01)

(58) Field of Classification Search
USPC ..... 221/45
See application file for complete search history.

(56) References Cited

U.S. PATENT DOCUMENTS 2,323,395 A * 7/1943 Harwood ..... B65D 83/0805 221/48
2,640,587 A * 6/1953 Smith ..... B65D 83/0805 206/37
3,083,866 A * 4/1963 Strange ..... B65D 5/16 221/48
4,180,160 A * 12/1979 Ogawa ..... A47K 10/3818 206/210
4,848,575 A * 7/1989 Nakamura ..... B65D 83/0805 206/449
5,219,421 A * 6/1993 Tipping ..... B65D 83/0805 206/233
5,265,785 A * 11/1993 Chudy ..... B65D 83/0805 206/278
5,947,672 A * 9/1999 Cohen ..... G09F 3/04 40/310
6,158,614 A * 12/2000 Haines ..... A47K 10/3818 221/33
6,688,488 B2 * 2/2004 Bailey ..... B65D 83/0811 221/45
6,766,919 B2 * 7/2004 Huang ..... B65D 83/0805 206/210
6,910,579 B2 * 6/2005 Reinke ..... A47K 10/421 206/494
7,275,654 B2 10/2007 Christensen
7,886,933 B2 * 2/2011 Hirasawa ..... B65D 83/0805 221/302
8,534,496 B2 9/2013 Crabill
8,573,398 B2 * 11/2013 Reinke ..... A47K 10/421 206/494
8,857,614 B2 * 10/2014 Gordon ..... B65D 83/0805 206/494
2008/0116217 A1 * 5/2008 Klein ..... A47K 10/421 221/1
2009/0289078 A1 * 11/2009 Melin ..... A47K 10/421 221/45
2011/0297693 A1 * 12/2011 Crabill ..... B65D 5/0209 221/45
2014/0001197 A1 * 1/2014 Crabill ..... B65D 83/0805 221/64
2015/0048105 A1 * 2/2015 Gordon ..... B65D 83/0805 221/63
2015/0048106 A1 * 2/2015 Crabill ..... B65D 83/0805 221/64
2015/0272406 A1 10/2015 Hill et al.
2019/0291942 A1 * 9/2019 Lange ..... B65D 83/0894

FOREIGN PATENT DOCUMENTS

WO 08025980 A1 3/2008
WO 11075460 A1 6/2011
WO 13076467 A2 5/2013
WO 14001998 A2 1/2014
WO 14128694 A1 8/2014
WO 14199409 A1 12/2014
WO 14203321 A1 12/2014
WO 15150935 A1 10/2015

* cited by examiner

STORING AND DISPENSING CONTAINER FOR WIPES

BACKGROUND OF THE DISCLOSURE

There are a variety of storing and dispensing containers for wipes in the market. Wipe type products or wipes have been made from a variety of materials which can be dry or wet when used. Wet wipes can be moistened with a variety of suitable wiping solutions. Often, wet wipes are stacked in a container in either a folded or unfolded configuration. For example, containers of wet wipes have been available wherein each of the wet wipes stacked in the container has been arranged in a folded configuration such as a c-folded, z-folded or quarter-folded configuration as are well known to those skilled in the art. Sometimes each folded wet wipe is interfolded with the wet wipes immediately above and below it in the stack of wipes. In an alternative configuration, the wet wipes have been placed in a container in the form of a continuous web of material that includes perforations adapted to allow for separation of individual wet wipes from the web upon the application of a pulling force. Such wet wipes have been used for baby wipes, hand wipes, personal care wipes, household cleaning wipes, industrial wipes and the like.

"Pop-up" configurations of wet wipe dispensers can advantageously help provide the aforementioned single-handed, "one-at-a-time" dispensing. In "pop-up" configurations, when a wipe is removed from the dispenser, the wipe pulls along the leading end of the succeeding wipe in the package, by virtue of the succeeding wipe being in operative contact with the leading wipe such as via interfolding, via adhesive bonding, or via an integral connection along a line of weakness. Preferably, as the leading wipe is pulled out of and away from the package, the trailing end of the leading wipe breaks free from the leading end of the succeeding wipe, and the leading end of the succeeding wipe is left protruding from the package. In this way, the leading end of the succeeding wipe is immediately and automatically positioned for grasping and subsequent withdrawal from the package, and what was previously the succeeding wipe now becomes the leading wipe.

Historically, two malfunctions can occur during the operation just described. In one scenario, as the leading wipe is withdrawn, the leading wipe may not properly release from the succeeding wipe, with the result that the succeeding wipe is pulled too far or even entirely out of the package. A situation in which one or more succeeding wipes are in a single pull operation withdrawn from the package by virtue of being in operative contact with the leading wipe is referred to herein as "multiples." Multiples can result from excessively strong connections between successive wipes (e.g., too much adhesive or insufficient web perforations), or can result from a dispensing orifice that does not sufficiently hold in place the succeeding wipe to allow the leading wipe to break free (e.g., too large of a dispensing orifice).

In another scenario, as the leading wipe is withdrawn, the succeeding wipe, after breaking free from the leading wipe, may not be readily accessible for subsequent dispensing. For example, although the leading end of the succeeding wipe may momentarily protrude from the package as it follows the leading wipe during withdrawal of the leading wipe, the leading end of the succeeding wipe often subsequently falls back through the dispensing orifice into the dispensing container—herein referred to as a "fallback." Fallbacks can result from insufficiently strong connections between successive wipes (i.e., not enough adhesive or an excessively weak line of weakness), or can result from a dispensing orifice that does not sufficiently hold the leading edge of the succeeding wipe in an outwardly protruding manner (i.e., too large of a dispensing orifice).

Many wipes packages include a flexible pouch to which a rigid closed-loop flange is attached. A rigid flip top is commonly hingedly attached to the flange. Within the closed-loop flange, the flexible pouch commonly includes a removable portion. The removable portion can be peeled away to define a dispensing orifice. When the package is full, it is common for the flexible pouch material to fit snugly around the stack of wipes within the package. One problem frequently encountered with such flexible pouch dispensing packs is that because of minimal "head space" between the top of the stack and the pouch material, the first several wipes can be difficult to extract from the dispenser. As the top wipe is pulled away from the stack, it bunches to an extent, and there is in conventional flexible packs insufficient head space to properly accommodate such bunching. Consequently, one or more of the first several wipes may become stuck, and may tear, which is frustrating to the consumer. Furthermore, even if the wipe properly dispenses, the succeeding wipe may "fallback" as described earlier.

As a result, what is further lacking in the art is a flexible pouch that has a rigid closed-loop flange and that provides more reliable dispensing of the first several wipes in a snugly packed package of wipes, reducing the potential for jams, tears, and fallbacks.

SUMMARY OF THE DISCLOSURE

In response to the aforementioned needs, a new storing and dispensing container for product has been invented.

In one embodiment, a storing and dispensing container for moist wipes defines a length dimension, a width dimension, and a height dimension, the length dimension, width dimension, and height dimension all being perpendicular to each other. The container includes a stack of moist wipes, the stack having a stack length that extends in the length dimension, a stack width that extends in the width dimension, and a stack height that extends in the height dimension. The stack has a stack top surface and a stack bottom surface spaced from one another in the height dimension, has first and second end walls spaced from one another in the length dimension, and has first and second side walls spaced from one another in the width dimension. The container further includes a flexible film pouch surrounding the stack of moist wipes. The flexible film pouch has an inner surface generally facing the stack of moist wipes, and an opposing outer surface, and the flexible film pouch defines a dispensing orifice. The container also includes a rigid flip top comprising a lid connected to a flange by a hinge. The flange is affixed to the outer surface of the pouch, and the flange surrounds the dispensing orifice. The flange is able to assume a bent state and an unbent state, wherein when in the unbent state the flange defines a flange length that extends in the length dimension and a flange width that extends in the width dimension. The flange length and the flange width together define a flange plane. The flange plane is generally parallel to the stack top surface, and the flange length is less than 80 percent of the stack length and the flange width is less than 80 percent of the stack width. The flange has a first hinge and a second hinge that each extend along a first bending axis, such than when a top wipe is extracted from the package through the dispensing orifice, the first bending axis is pulled away from the stack, and the flange bends about the first bending axis to assume the bent state. The flexible film pouch is substantially moisture impervious other than the presence of the dispensing orifice. In particular embodiments, one or more of the hinges can be defined by an area of reduced flange thickness; an area of reduced flange width; and/or an area of reduced flange rigidity. In certain embodiments, the flange includes a plurality of strengthening ribs, and one or more hinges can be defined by a gap in the ribs.

It is to be understood that both the foregoing general description and the following detailed description are exemplary and are intended to provide further explanation of the invention claimed. The accompanying drawings, which are incorporated in and constitute part of this specification, are included to illustrate and provide a further understanding of the packages of the invention. Together with the description, the drawings serve to explain the various aspects of the invention.

BRIEF DESCRIPTION OF THE DRAWINGS

The present invention will be more fully understood and further features will become apparent when reference is made to the following detailed description of the invention and the accompanying drawings. The drawings are merely representative and are not intended to limit the scope of the claims. Like parts of the packages depicted in the drawings are referred to by the same reference numerals.

DETAILED DESCRIPTION OF PARTICULAR EMBODIMENTS

Figure 1A:
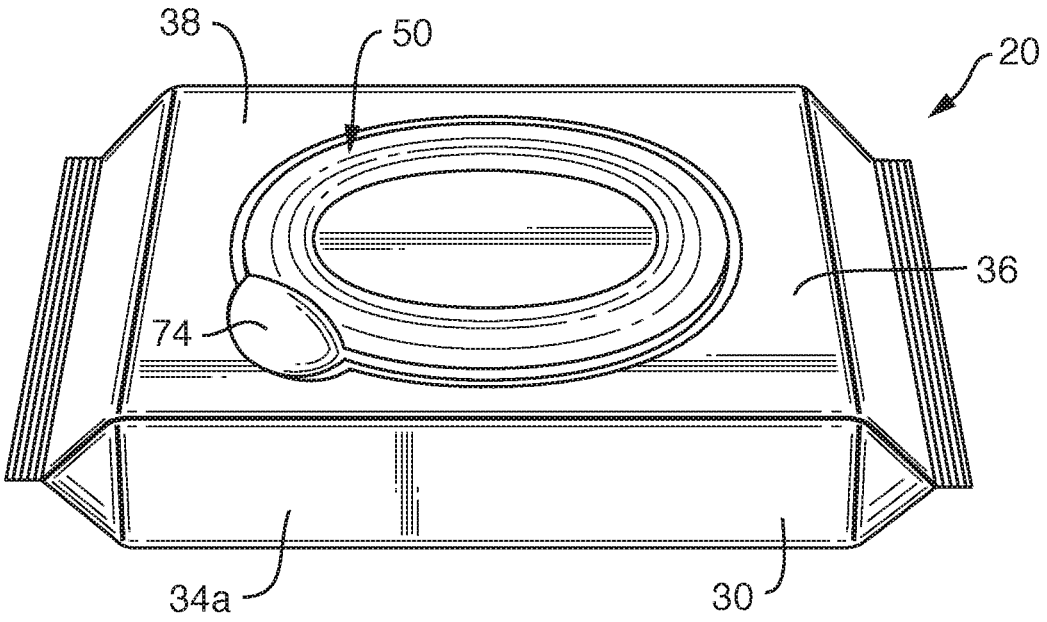
FIG. 1A representatively shows a perspective view of an example of a dispensing container for wipes suitable for use in conjunction with particular embodiments of the present invention with the rigid flip top lid closed.

In particular embodiments, the invention pertains to a storing and dispensing container 20 for moist wipes. The container defines a length dimension 10, a width dimension 11, and a height dimension 12, all of which are perpendicular to each other. The container 20 includes a stack of moist wipes 22. The stack 22 has a stack length 13 that extends in the length dimension 10, a stack width 14 that extends in the width dimension 11, and a stack height 15 that extends in the height dimension 12. The stack has a stack top surface 16 and a stack bottom surface 17 spaced from one another in the height dimension 12. The stack has first and second end walls 18*a*, 18*b* spaced from one another in the length dimension 10, and the stack has first and second side walls 19*a*, 19*b* spaced from one another in the width dimension 11.

Figure 2A:
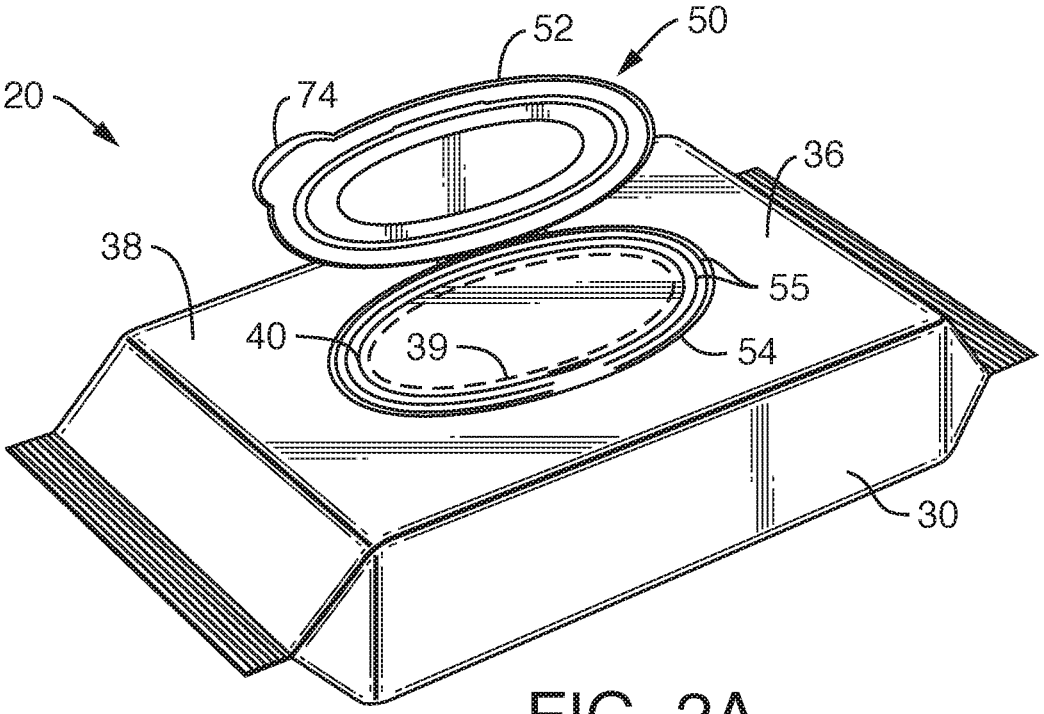
FIG. 2A representatively shows a perspective view of the example of FIG. 1A with the rigid flip top open, and having a conventional flange.
Figure 2B:
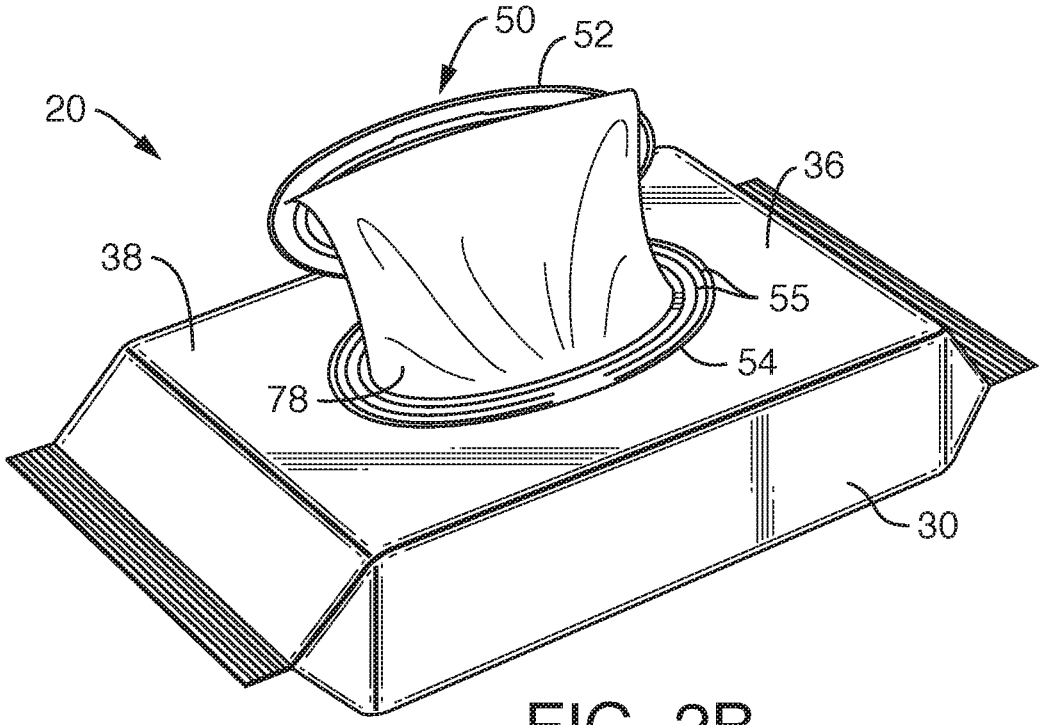
FIG. 2B representatively shows the example of FIG. 2A with a wipe partially extracted.
Figure 3A:
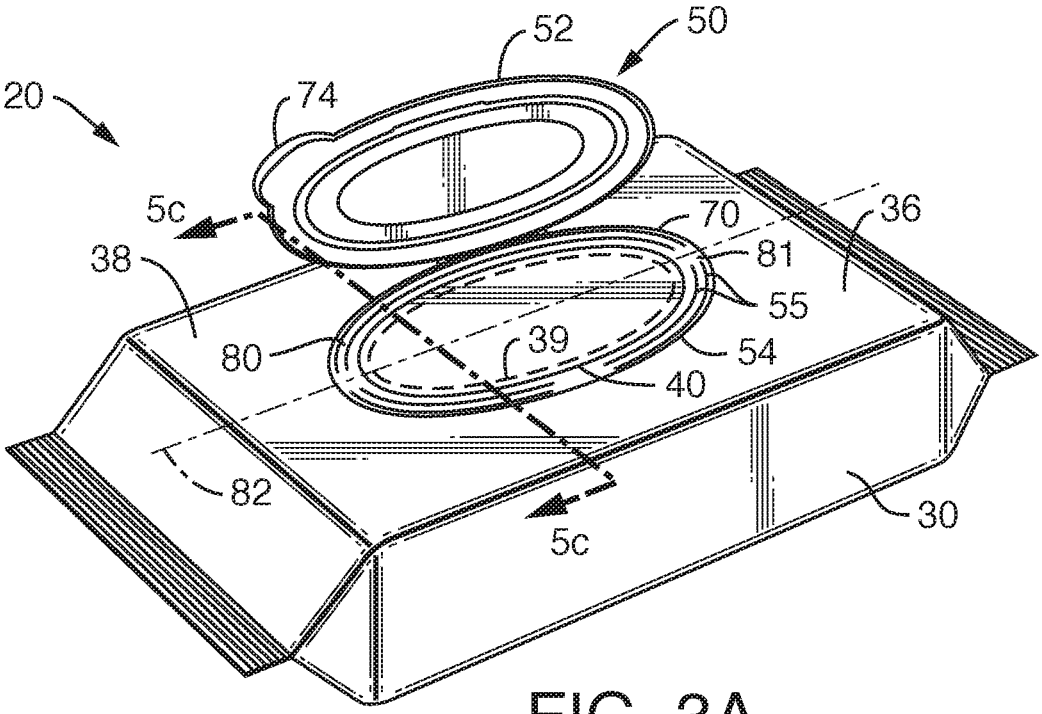
FIG. 3A representatively shows a perspective view of the example of FIG. 1A with the rigid flip top open, and having a flange in accordance with one embodiment of the invention.
Figure 3B:
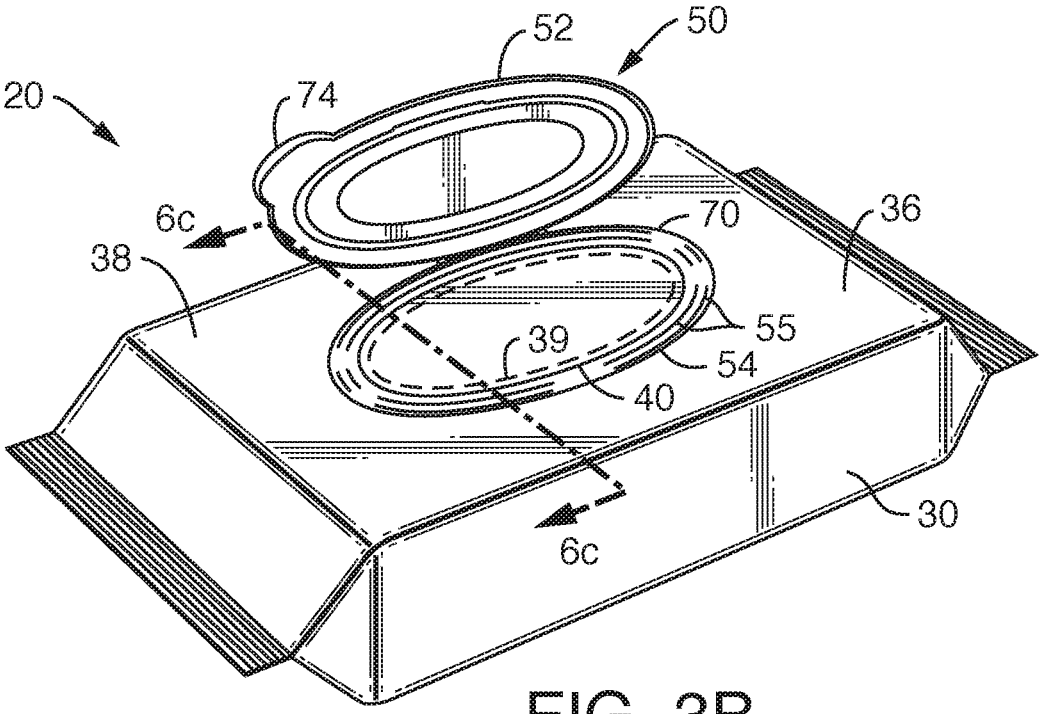
FIG. 3B representatively shows a perspective view of the example of FIG. 1A with the rigid flip top open, and having a flange in accordance with another embodiment of the invention.
Figure 4:
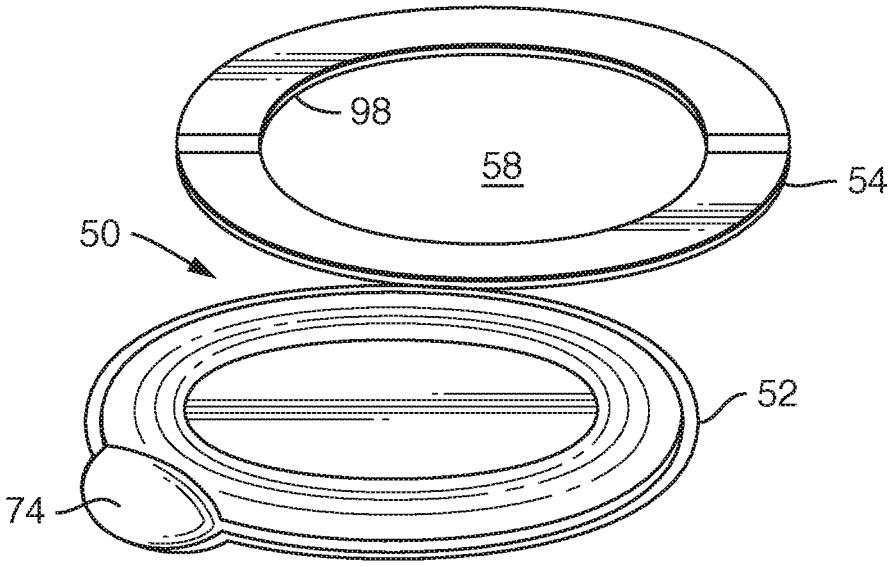
FIG. 4 representatively shows a perspective view of a rigid flip top in accordance with one embodiment of the invention, with the lid laid open relative to the flange to present the outside of the rigid flip top.

A flexible film pouch 30 surrounds the stack of moist wipes 22. The flexible film pouch 30 has an inner surface 37 generally facing the stack of moist wipes 22, and an opposing outer surface 38. The film pouch in particular embodiments defines a bottom portion 32 and a top portion 36 overlying the bottom portion 32. The pouch 30 defines first and second side wall portions 34*a*, 34*b* that face the first and second stack side walls 19*a*, 19*b*, respectively. In particular embodiments, the top portion 36 includes a removable portion 40 which seals the stack of wipes 22 within the pouch 30 in a first condition (as seen in FIGS. 2A and 3A, i.e., before the product is dispensed the first time) and which allows access to the product within the pouch in a second condition (i.e., when the removable portion 40 is removed and the rigid flip top 50 is in an open condition, as shown in FIG. 2B). Referring to FIGS. 2A, 3A, and 3B, the removable portion 40 of the pouch 30 may in particular embodiments be defined by a frangible line of weakness 39. Such line of weakness 39 can take the form of a line of intermittent perforations, such as a line of perforations provided by a die cutter or could comprise a scored line formed in the pouch 30. The removable portion 40 is adapted to be pulled off, peeled away, or otherwise removed from the pouch 30 to reveal a dispensing orifice 78, through which wipes can be withdrawn from the container 20. Optionally, the removable portion 40 can be overlaid by a label, such as an adhesively attached label, which can be configured to be either resealable or configured to be disposed of immediately after the initial opening of the pouch. Preferably, the flexible film pouch 30 is substantially moisture-impervious.

Figure 1B:
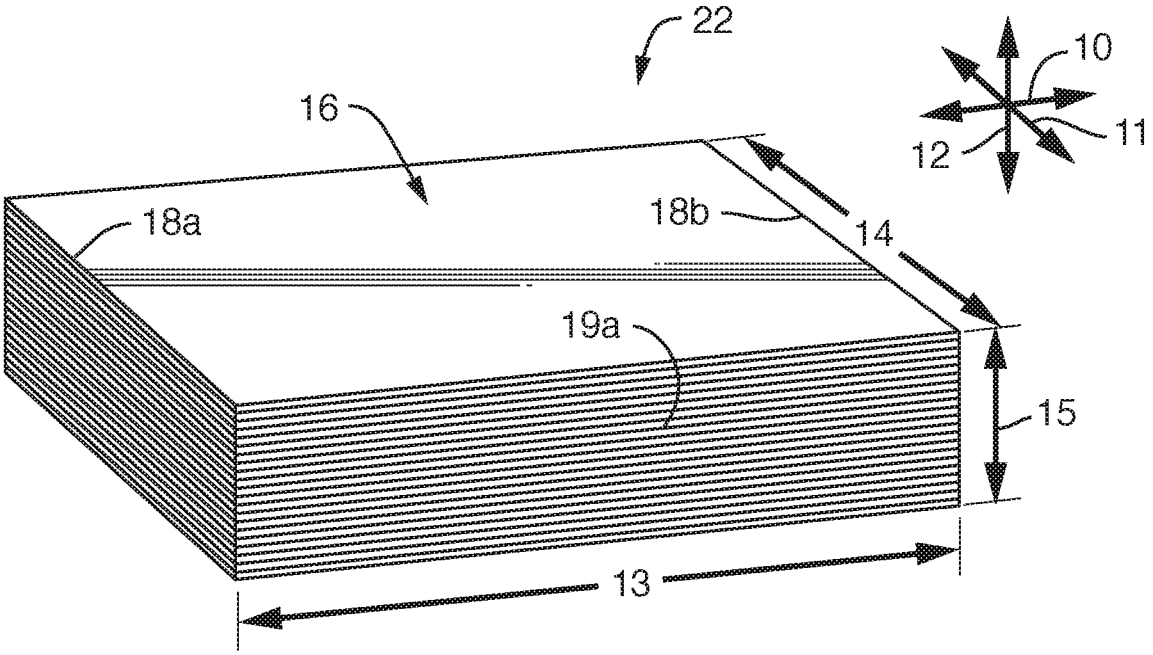
FIG. 1B representatively shows a perspective view of a stack of moist wipes suitable for use in conjunction with particular embodiments of the invention.
Figure 5A:
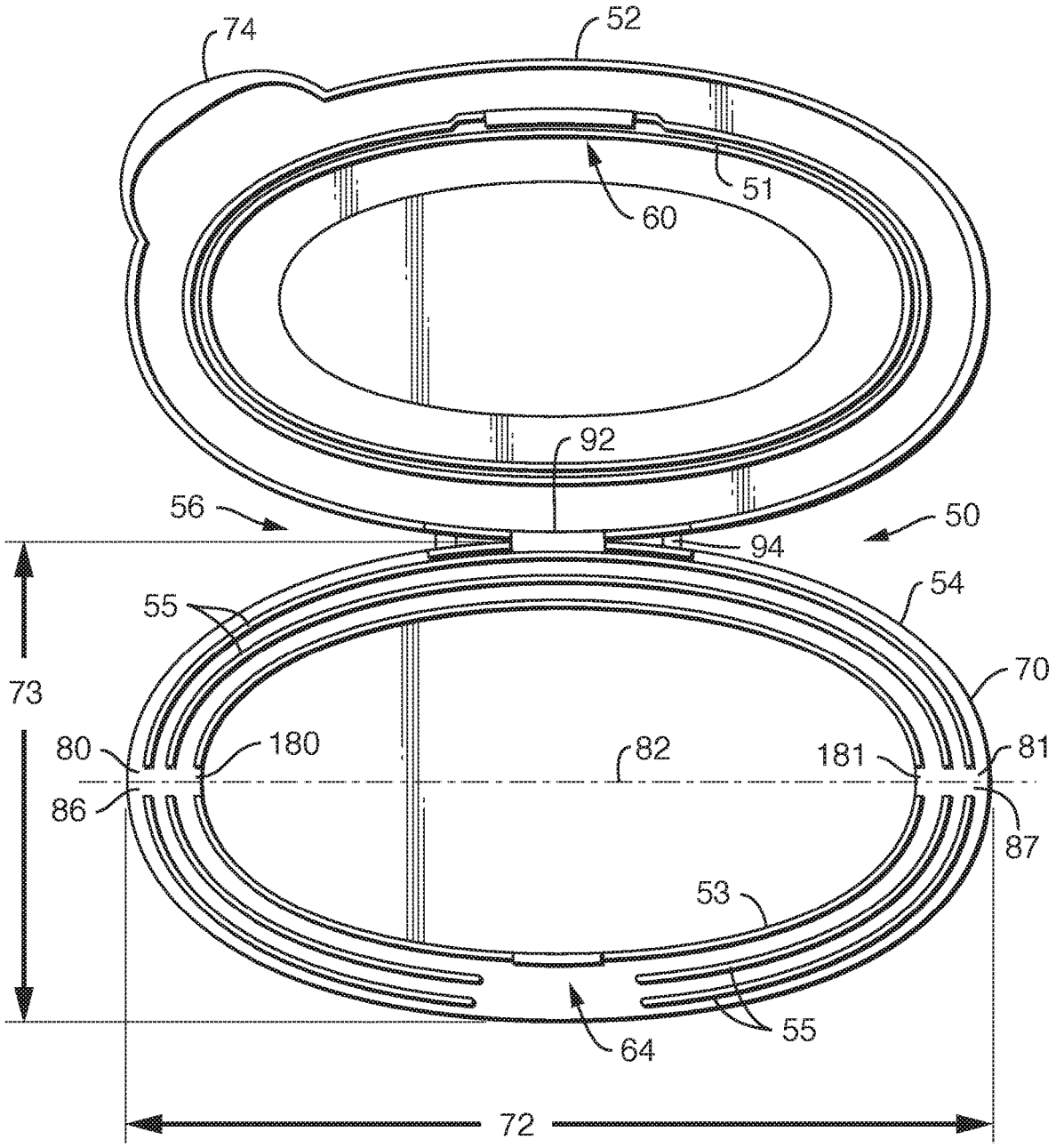
FIG. 5A representatively shows an enlarged top view of a rigid flip top in accordance with one embodiment of the invention, with the lid and the flange laid open flat to present the inside of the rigid flip top.
Figure 5B:
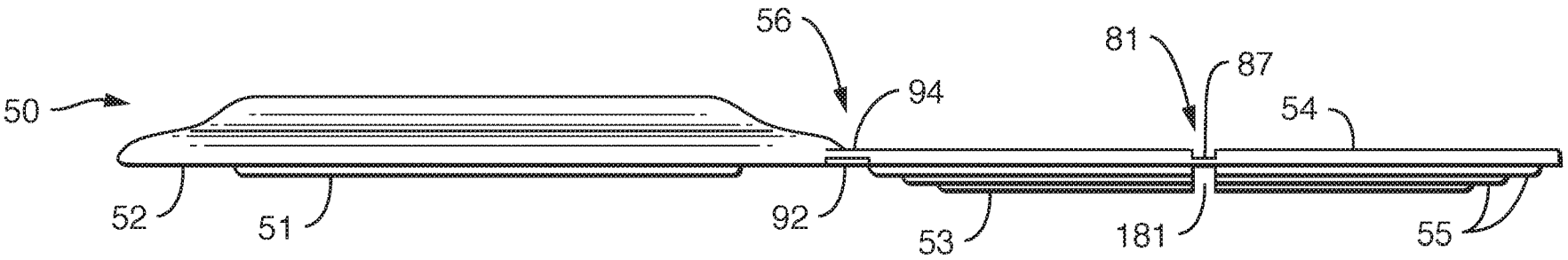
FIG. 5B representatively shows a side view of the rigid flip top of FIG. 5A.
Figure 5C:
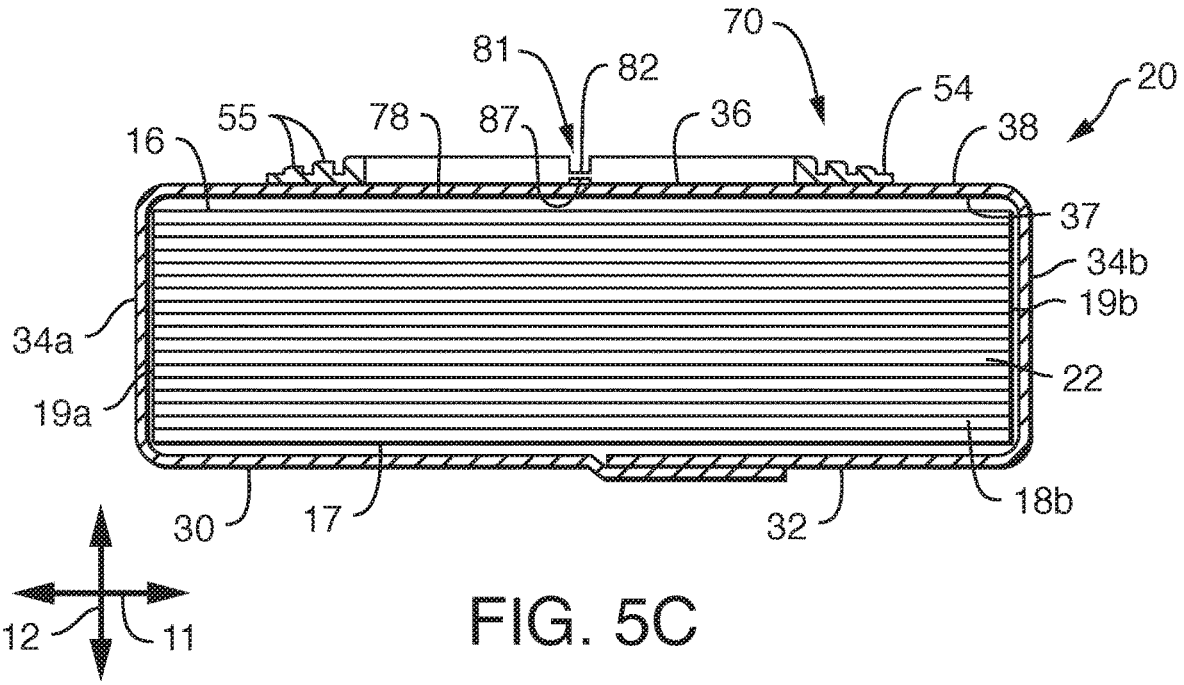
FIG. 5C representatively shows a cross-sectional view of the container for wipes illustrated in FIG. 3A with a stack of wipes therein, viewed along the line 5C-5C, with the lid absent.
Figure 5D:
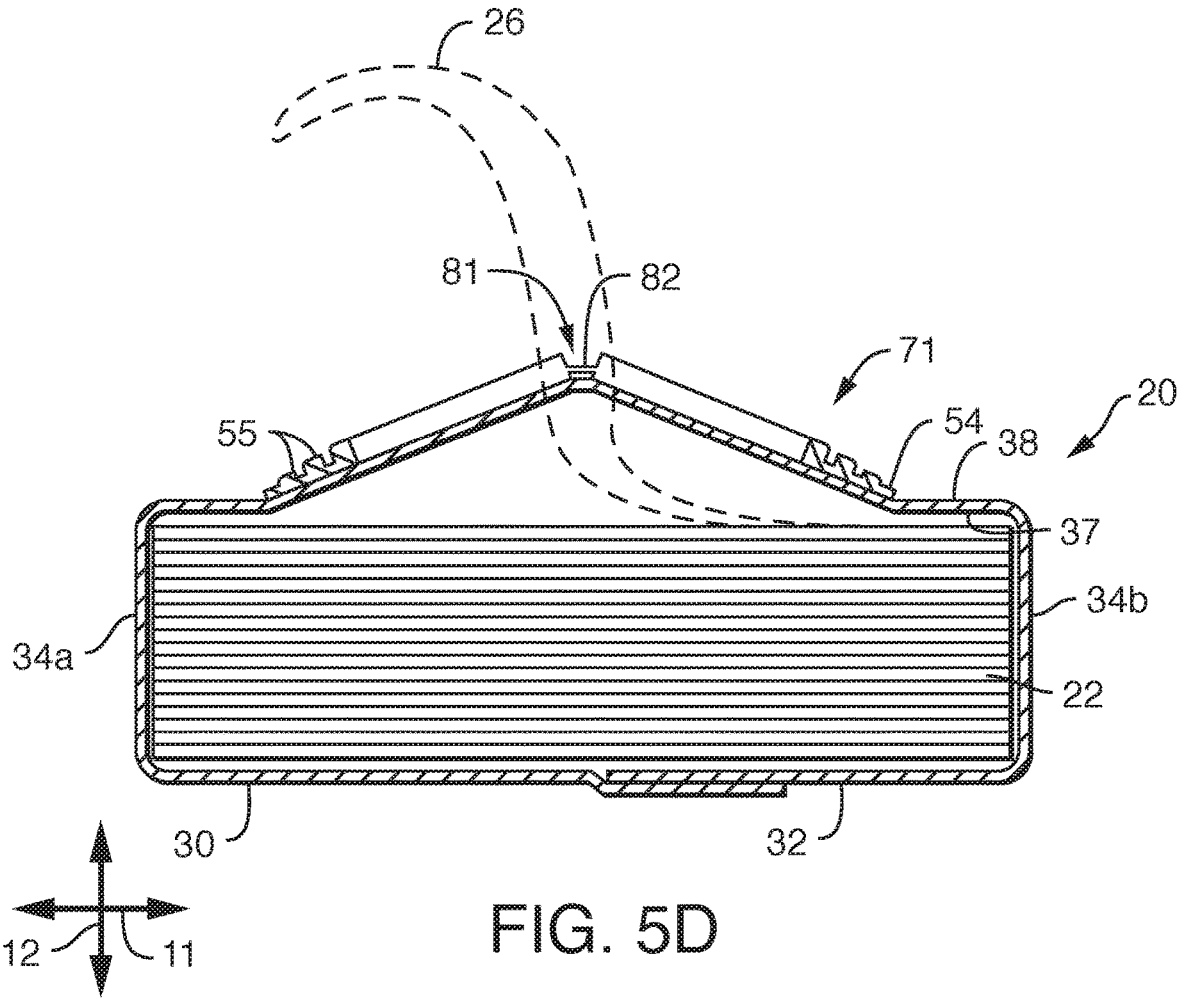
FIG. 5D representatively shows the embodiment of FIG. 5C, depicting an exemplary orientation of the flange during extraction of a wipe from the top of the stack of wipes.
Figure 5E:
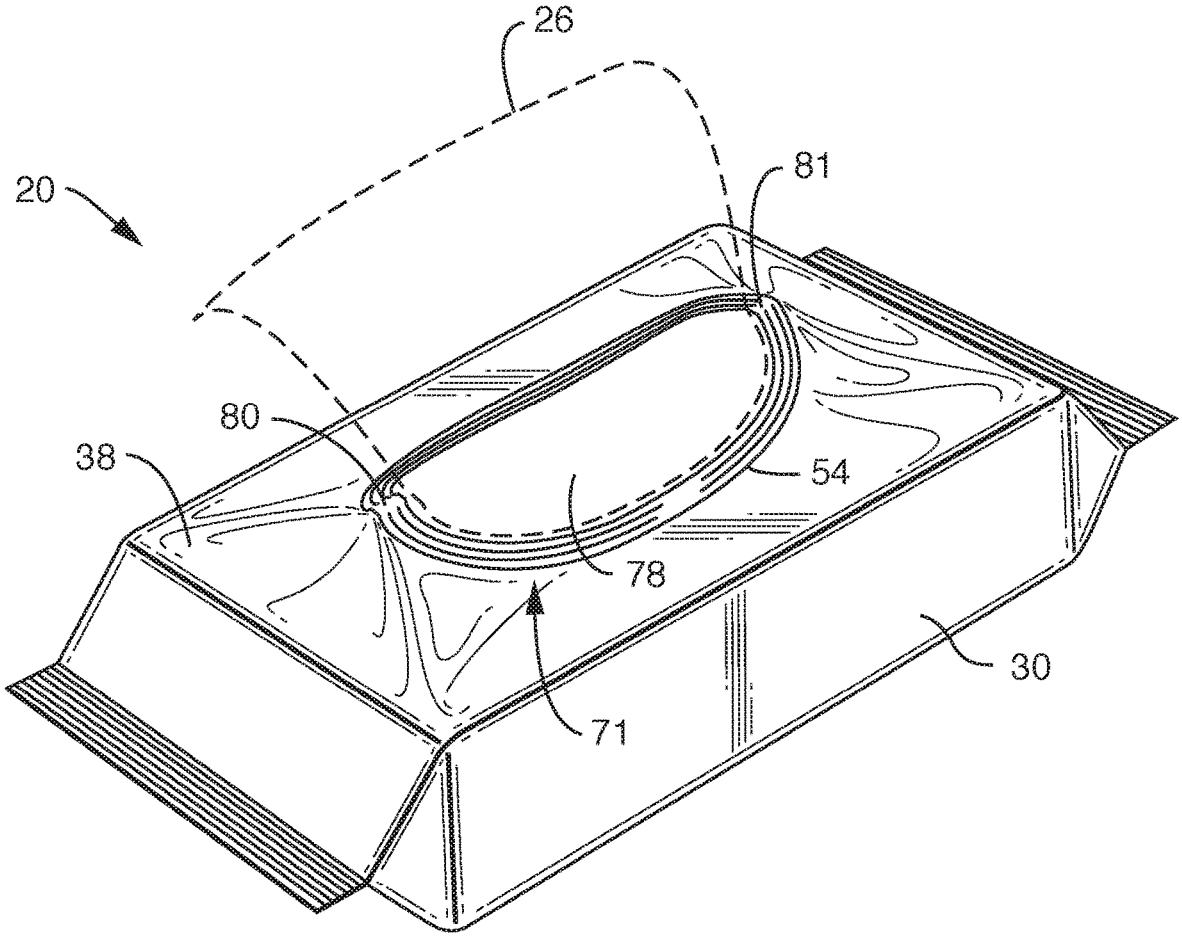
FIG. 5E representatively shows a perspective view of the embodiment of FIG. 5D, depicting an exemplary orientation of the flange during extraction of a wipe from the top of the stack of wipes.
Figure 6A:
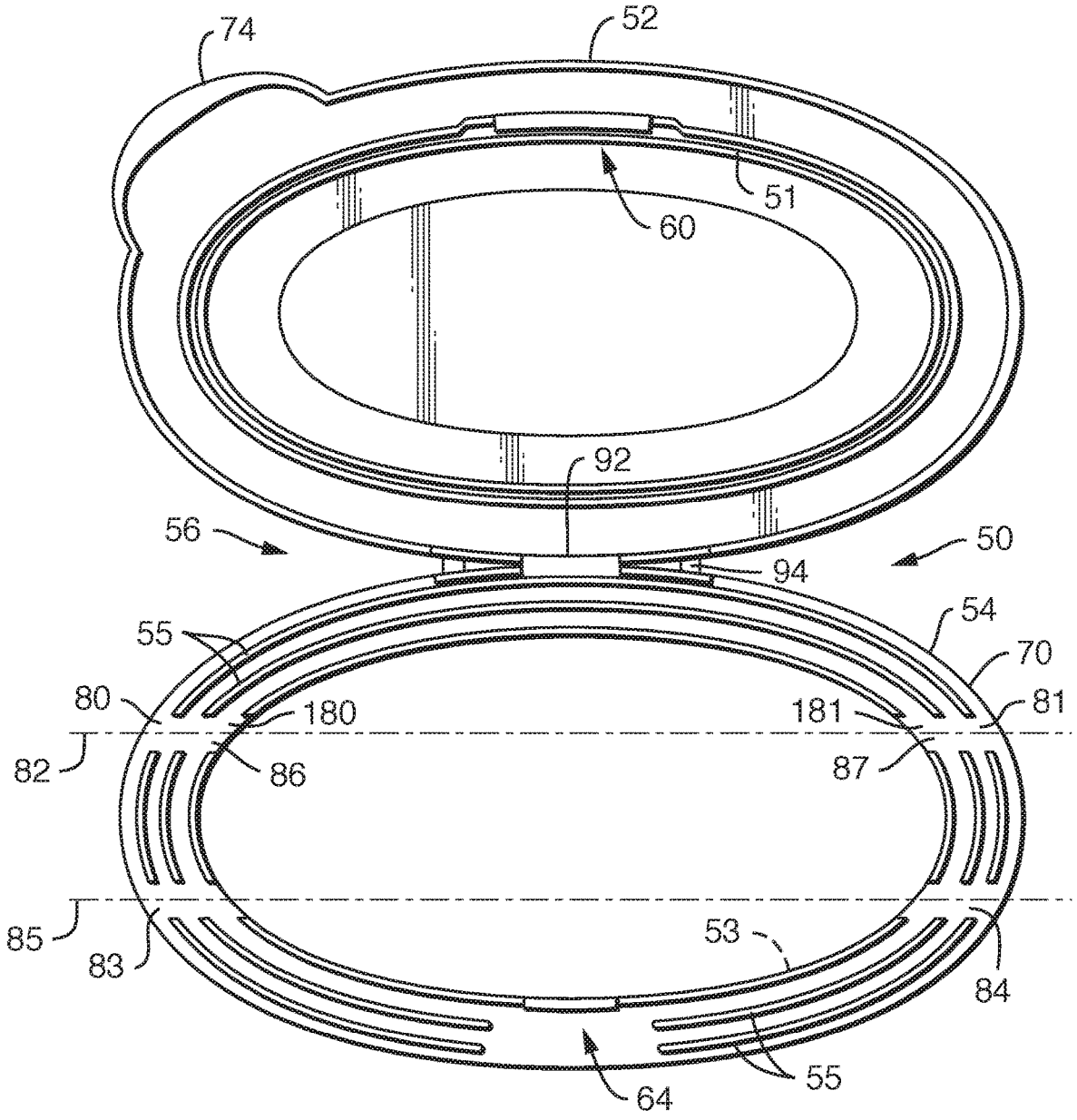
FIG. 6A representatively shows an enlarged top view of a rigid flip top in accordance with another embodiment of the invention, with the lid and the flange laid open flat to present the inside of the rigid flip top.
Figure 6B:
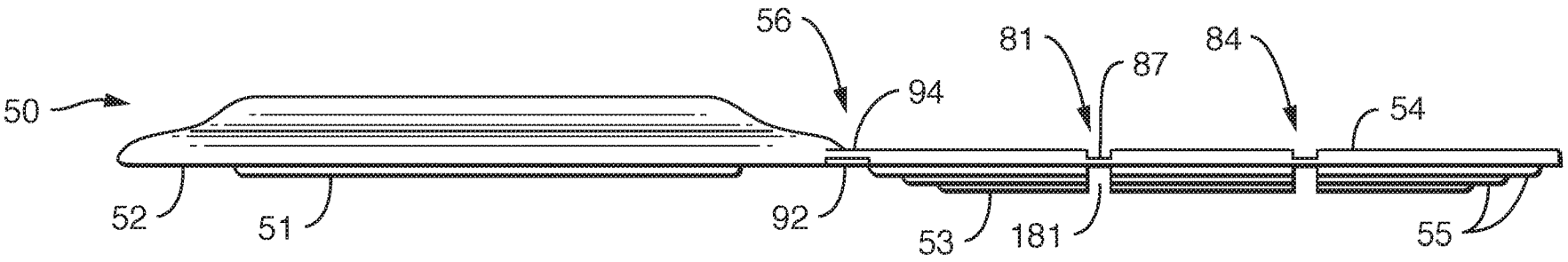
FIG. 6B representatively shows a side view of the rigid flip top of FIG. 6A.
Figure 6C:
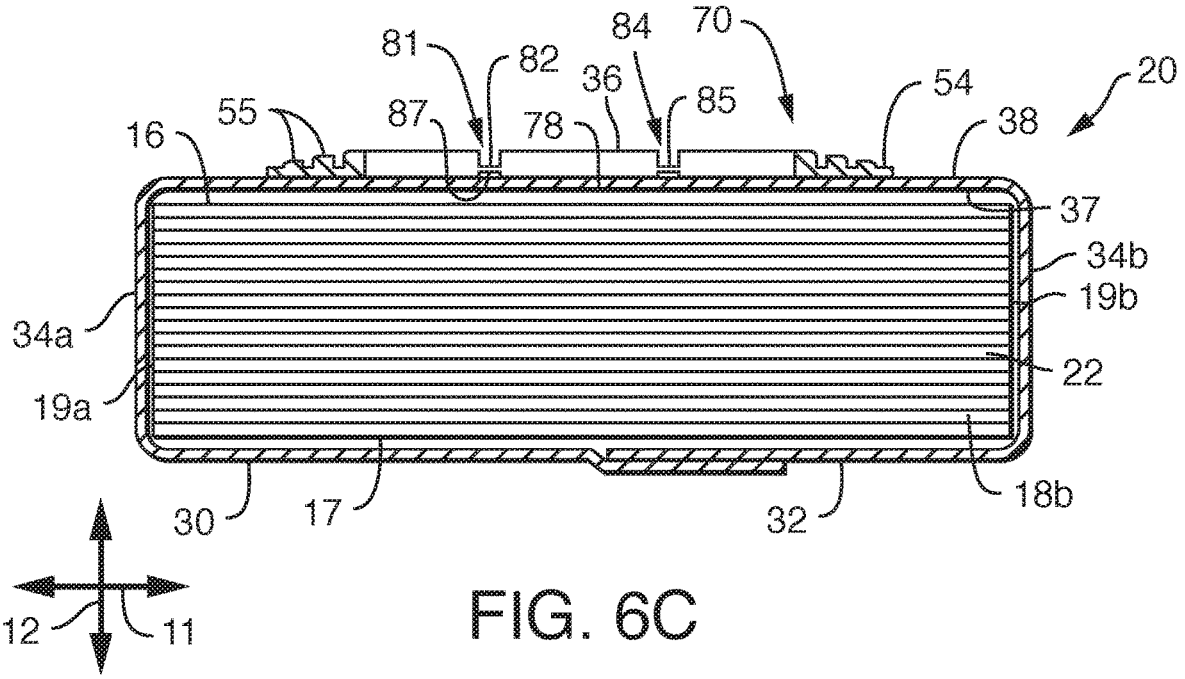
FIG. 6C representatively shows a cross-sectional view of the container for wipes illustrated in FIG. 3B with a stack of wipes therein, viewed along the line 6C-6C, with the lid absent.
Figure 6D:
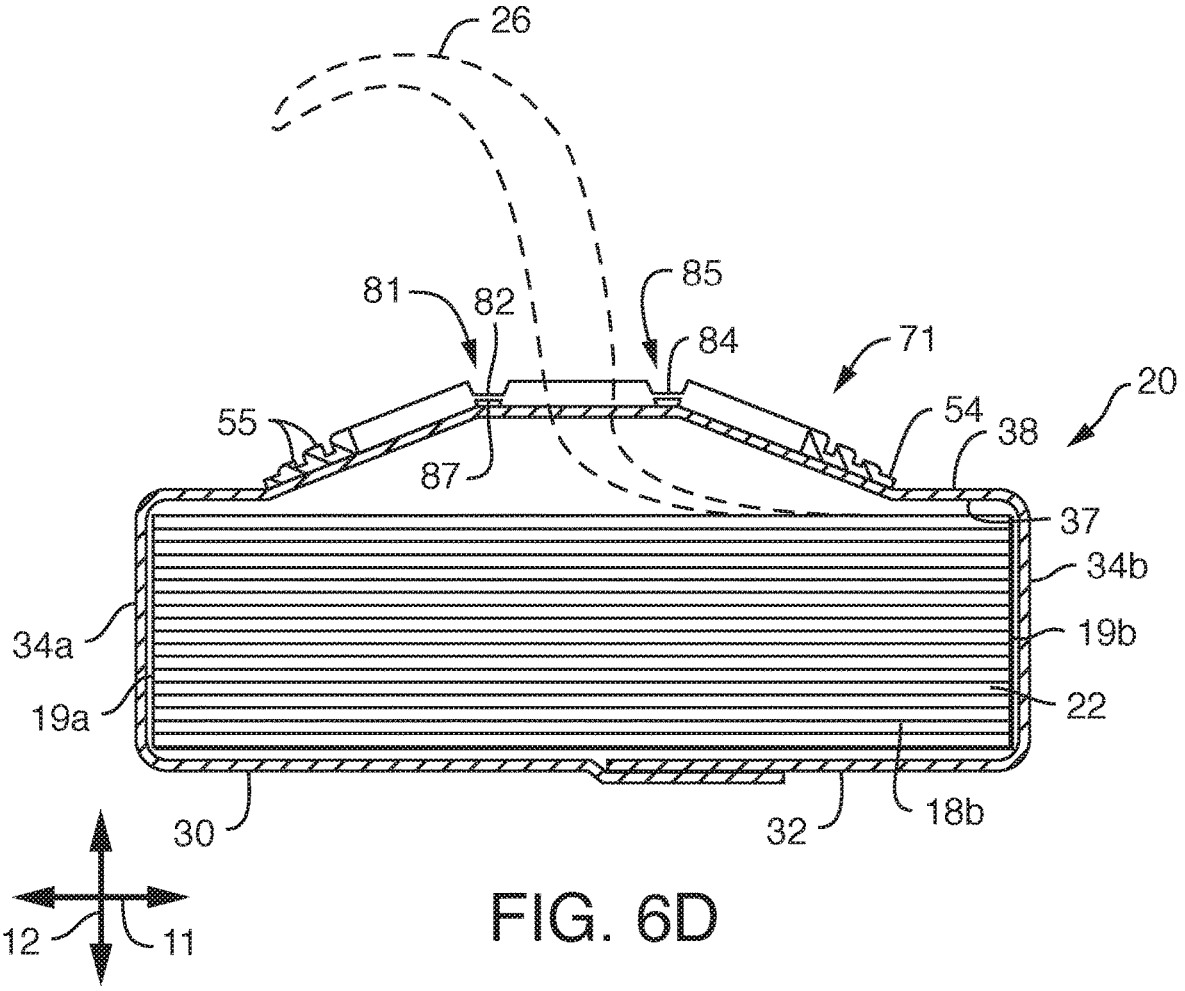
FIG. 6D representatively shows the embodiment of FIG. 6C, depicting an exemplary orientation of the flange during extraction of a wipe from the top of the stack of wipes.
Figure 6E:
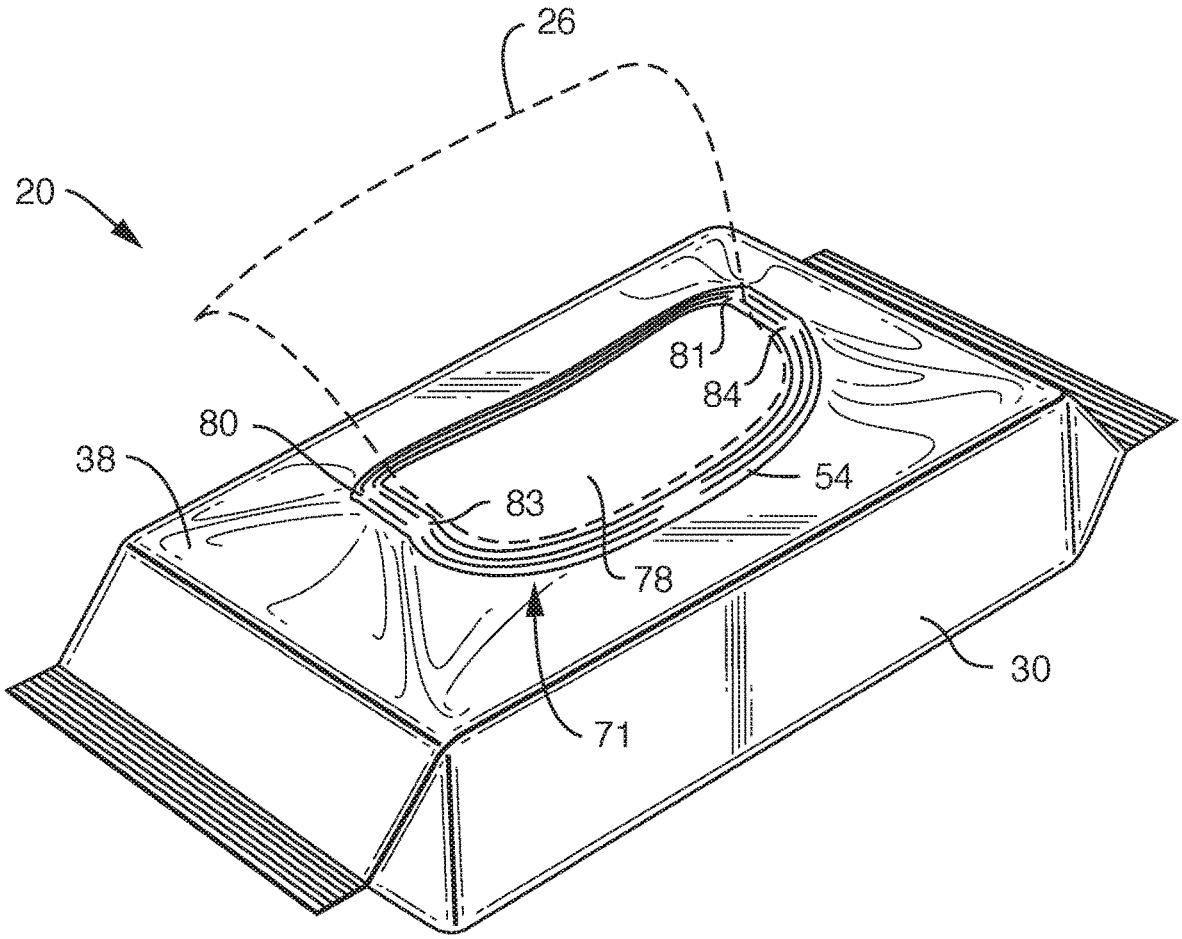
FIG. 6E representatively shows a perspective view of the embodiment of FIG. 6D, depicting an exemplary orientation of the flange during extraction of a wipe from the top of the stack of wipes.

The container 20 also includes a rigid flip top 50. The rigid flip top 50 includes a lid 52 connected to a flange 54 by a hinge 56. The flange 54 is affixed to the outer surface 38 of the pouch at the top portion 36 of the pouch 30, and the flange 54 surrounds the dispensing orifice 78. The lid 52 is removably positionable to be closed (e.g., as seen in FIG. 1) to engage the flange 54 and thereby seal the pouch at the outer surface 38 where the removable portion 40 is surrounded by the flange 54 and covered by the lid 52, and to thus seal the pouch 30 and stack of moist wipes 22 therein from the environment outside the pouch 30 after the removable portion 40 is removed and no further wipes are desired during a particular dispensing occasion. The lid 52 can include an annular sealing ring 51 that extends downward from the inside of the lid and that is sized to fit against an annular sealing ring 53 that extends upward from the inside of the flange (FIGS. 5A, 5B, 6A, and 6B), to assist in better sealing the lid 52 to the flange 54 when the lid 52 is closed. Referring to FIGS. 5A and 6A, the lid can include a latch 60, and the flange 54 can include a catch 64 designed to engage the latch 60 in an interference fit to keep the lid closed. The flange 54 can optionally include strengthening ribs 55 around the flange to stiffen the flange 54 as desired, as representatively illustrates in FIGS. 2, 3, 5, and 6.

Referring to FIGS. 3, 5, and 6, the flange 54 can assume an unbent state 70 and a bent state 71. In the unbent state 70, the flange 54 defines a flange length 72 that extends in the length dimension 10 and a flange width 73 that extends in the width dimension 11. In the unbent state 70, the flange length 72 and the flange width 73 together define a flange plane, and in the unbent state 70 the flange plane is generally parallel to the stack top surface 16. In particular embodiments, the flange length 72 is less than 80 percent of the stack length 13. In particular embodiments, the flange width 73 is less than 80 percent of the stack width 14.

Referring to FIGS. 3A and 5, the flange 54 has a first hinge 80 and a second hinge 81 that each extend along a first bending axis 82. As shown in FIGS. 5D-5E, when a top wipe 26 is extracted from the pouch 30 through the dispensing orifice 78, the first bending axis 82 is pulled away from the stack 22, and the flange 54 bends about the first bending axis 82 to assume the bent state 71. The bent state 71, in allowing the central portion (along the bending axis 82) to move up and away from the stack 22, delivers additional headspace within the pouch 30. This additional headspace better accommodates the folding and bunching that the wipe 26 experiences as it is withdrawn from the pouch 30, helping to reduce the jams and fallbacks described earlier.

Referring to FIGS. 3B and 6, in other embodiments, the flange also includes a third hinge 83 and a fourth hinge 84 that each extend along a second bending axis 85. As shown in FIGS. 6D-6E, when a top wipe 26 is extracted from the pouch 30 through the dispensing orifice 78, both the first bending axis 82 and the second bending axis 85 are pulled away from the stack 22, and the flange 54 bends about both the first bending axis 82 and the second bending axis 85. The bent state 71, in allowing the central portion (along the bending axes 82 and 85) to move up and away from the stack 22, delivers additional headspace within the pouch 30. This additional headspace better accommodates the folding and bunching that the wipe 26 experiences as it is withdrawn from the pouch 30, helping to reduce the jams and fallbacks described earlier.

Figure 7:
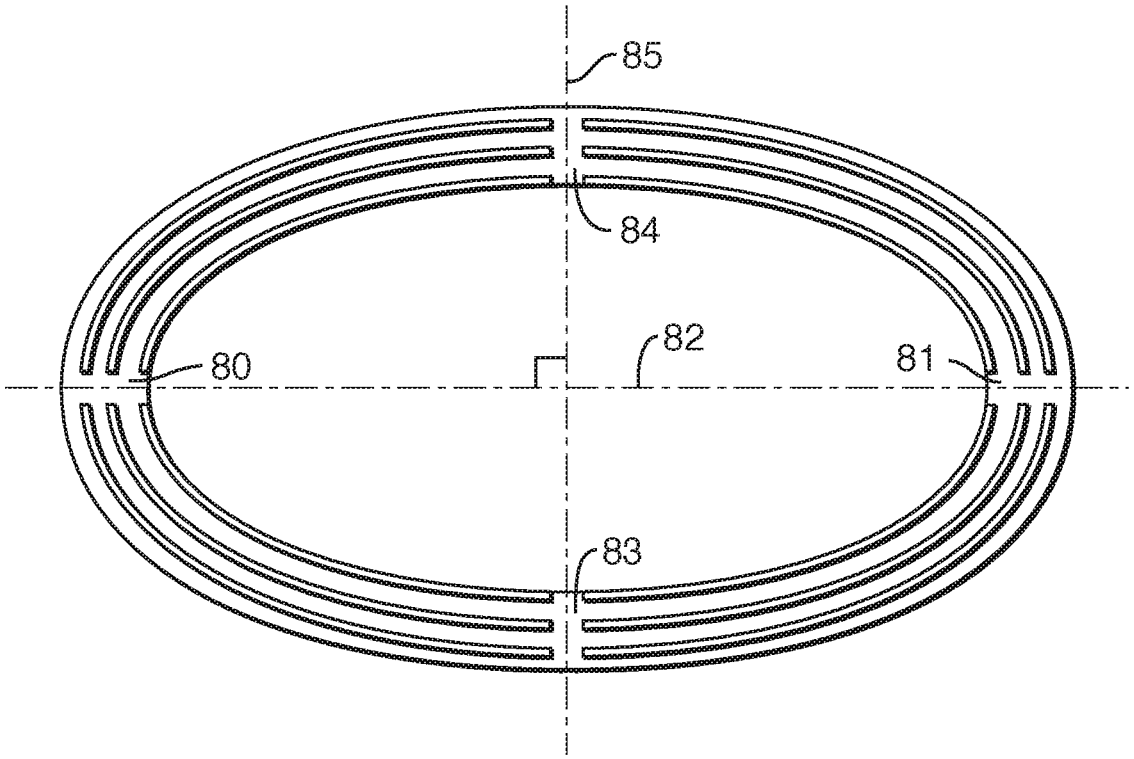
FIG. 7 representatively shows a top view of a rigid flip top flange in accordance with an alternative embodiment of the invention.

In embodiments having two bending axes, the first bending axis 82 can be parallel to the second bending axis 85, as representatively illustrated in FIGS. 3B and 6. In other embodiments, the first bending axis 82 can form an angle of 90 degrees with the second bending axis 85, as representatively illustrated in FIG. 7. In still other embodiments, the first bending axis 82 can form an angle of between 10 and 45 degrees with the second bending axis 85 (not shown).

Desirably, the stack of moist wipes 22 prevents the first and second side wall portions 34*a*, 34*b* of the pouch 30 from collapsing toward one another by more than 10 percent, more than 5 percent, or even more than 2 percent of the stack width when the flange 54 bends about the first bending axis 82 and/or the second bending axis 85 during extraction of the top wipe. The magnitude of the inward collapse or movement of the side wall portions should be measured at the "top wipe" position (in the height dimension), and can be measured using any suitable method in the art, such as using a larger caliper tool to measure the distance between the side wall portions before extraction of top wipe, and to measure the minimum distance between the side wall portions during extraction of the top wipe. The difference between these two distances is then compared, in percentage terms, to the stack width.

The various hinges in the flange can be created by any of various structural features. For example, in particular embodiments, the first hinge 80 is at least partially defined by a first area of reduced flange thickness 86. Similarly, the second hinge 81 is at least partially defined by a second area of reduced flange thickness 87. The third and fourth hinges 83, 84 can similarly be at least partially defined by areas of reduced thickness in the flange 54. "Flange thickness" is the height of the flange in the height dimension 12. "Area of reduced flange thickness" means an area lower in thickness than the thickness of immediately adjacent areas of the flange. Such areas of reduced thickness allow the flange to more easily bend upon the application of a force, creating a so-called "living hinge." In another example, one or more of the hinges 80, 81, 83, 84 can be at least partially defined by areas of reduced flange width. "Flange width" means the shortest distance between the inner edge perimeter and the outer edge perimeter at any given point around the "ring" forming the flange. "Area of reduced flange width" means an area lower in width than the width of immediately adjacent areas of the flange. Such areas of reduced width allow the flange to more easily bend upon the application of a force, creating a so-called "living hinge." In another example, one or more of the hinges 80, 81, 83, 84 can be at least partially defined by areas of reduced rigidity. Rigidity of a region of the flange is measured along a line extending in the width of the flange at any point around the "ring" forming the flange according to ASTM D790 "Standard Test Method for Flexural Properties of Unreinforced and Reinforced Plastics and Electrical Insulating Materials." "Area of reduced rigidity" means an area lower in rigidity than the rigidity of immediately adjacent areas of the flange. In particular embodiments in which the flange 54 includes a plurality of strengthening ribs 55 as described above, the first hinge 80 is at least partially defined by a first gap 180 in the ribs 55, and the second hinge 81 is at least partially defined by a second gap 181 in the ribs 55. The third and fourth hinges 83, 84 can similarly be at least partially defined by gaps in the ribs 55. Such gaps in the strengthening ribs allow the flange to more easily bend at the gaps upon the application of a force.

Figure 8A:
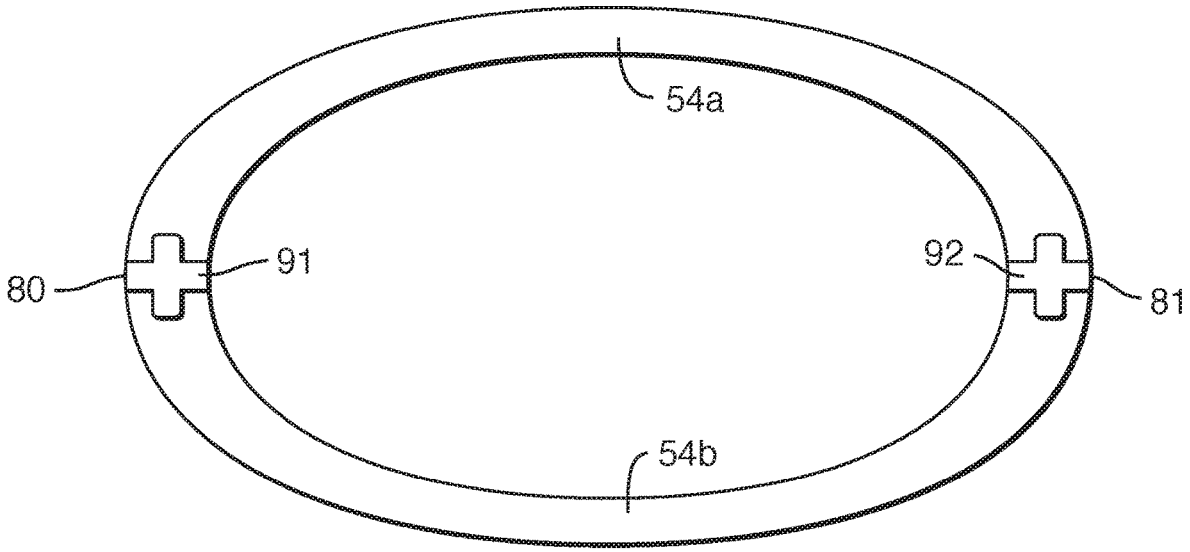
FIG. 8A representatively shows a top view of a rigid flip top flange in accordance with yet another alternative embodiment of the invention.
Figure 8B:
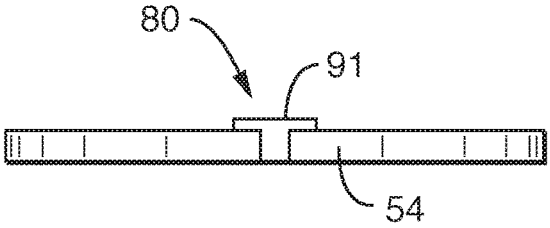
FIG. 8B representatively shows a side view of the flange of FIG. 8A.
Figure 9:
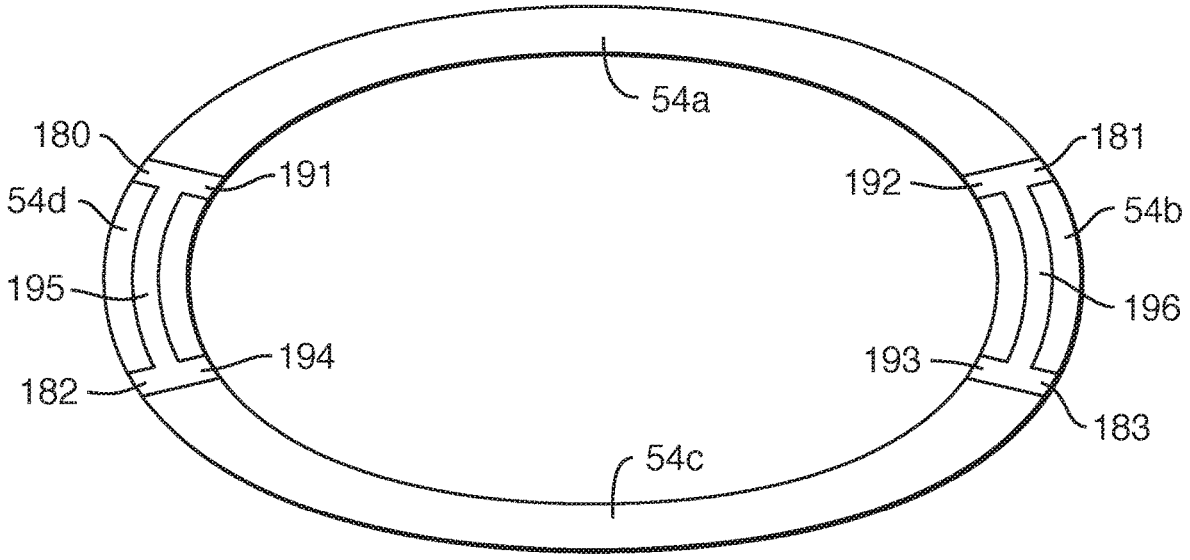
FIG. 9 representatively shows a top view of a rigid flip top flange in accordance with still another alternative embodiment of the invention.

In another example, the flange 54 is formed from a plurality of distinct, non-integrally-connected rigid thermoplastic portions joined together by one or more thermoplastic elastomer segments, such that each hinge in the flange includes thermoplastic elastomer material but each hinge does not include rigid thermoplastic material. For example, as representatively illustrated in FIGS. 8A-8B, the flange is formed from distinct pieces of rigid thermoplastic 54*a* and 54*b*. The rigid pieces 54*a* and 54*b* are joined together by thermoplastic elastomer segments 91 and 92. The first hinge 80 is formed where the elastomer segment 91 joins the rigid portions 54*a* and 54*b*, and the second hinge 81 is formed where the elastomer segments 92 joins the rigid portions 54*a* and 54*b*. In a similar example shown in FIG. 9, the flange is formed from distinct pieces of rigid thermoplastic 54*a*, 54*b*, 54*c*, 54*d*. The rigid pieces 54*a-d* are joined together by thermoplastic elastomer segments 191, 192, 193, 194. First, second, third, and fourth hinges 180, 181, 182, 184 are formed where the elastomer segments 191-194 join the rigid portions 54*a-d*. Elastomeric segments 191 and 194 are optionally integrally joined to each other by an elastomer strip 195, and elastomeric segments 192 and 193 are optionally integrally joined to each other by an elastomeric strip 196. Hinges formed in this manner (with elastomer bridging the gap between rigid pieces) are able to bend and twist with considerable flexibility along multiple bending axes, furthering improving the ability of the flange aspect of the invention to deliver additional headroom when withdrawing wipes from the stack inside of the pouch as described earlier.

In particular embodiments, the lid 52 includes an opening tab 74. The "opening tab" is defined herein as any portion of the lid that projects radially out from the lid away from the sealing portion of the rigid flip top and thereby enables a user to place at least one fingertip between the projecting portion and the flexible pouch to assist in separating the lid from the flange when moving the lid to the open position. The opening tab 74 protrudes from the rigid flip top 50 so that a user can more easily grasp it and have a more identifiable leverage point to open the lid. In particular embodiments, the opening tab 74 can be centered, or not centered, along the length 13. The lid may be of a substantially uniform simple geometric shape (e.g., circle, oval, triangle, square, rectangle, pentagon, hexagon, septagon, etc.) except for the optional opening tab 74 projecting outwardly of the lid perimeter.

In particular embodiments, the rigid flip top 50 includes a hinge 56 between the lid 52 and the flange 54. The hinge can be a living hinge, where "living hinge" means a hinge formed integrally with the members on either side of it. The hinge can include a central strap 92 and a pair of toggle straps 94, with each toggle strap 94 located on an opposite side of the central strap 92. The "affixed" relationship of the rigid flip top 50 to the pouch 30 can be by various mechanical and chemical methods known in the art, including, but not limited to, use of glue or other bonding material, thermal bonding or welding, ultrasonic bonding or welding, or other joining methods as long as they create a permanent joined relationship between the pouch 30 and the rigid flip top 50. The rigid flip top can be made by a variety of conventional techniques, including, for example, injection molding.

The flexible film pouch 30 can be formed from materials known in the art, such as polymers, including but not limited to polyethylene, polypropylene, polyesters, and the like, and combinations thereof.

The product, e.g., wipes or wet wipes, can be arranged in the pouch in any manner which provides convenient and reliable one at a time dispensing and which assists the wipes in not becoming dirty and/or overly dry. For example, the wipes may be arranged in a dispenser or container as a plurality of individual sheets arranged in a stacked configuration to provide a stack of wipes which may or may not be individually folded. The wipes may be individual wipes which are folded in a c-fold, z-fold, quarter fold or other zigzag fold or interfolded or non-interfolded configurations as are known to those skilled in the art. The product 22 may include a plurality of wipes stacked one on top of each other in a non-interfolded configuration, for "reach-in" dispensing. For such a non-interfolded wipe, each wipe is folded onto itself with no portion of another wipe being positioned between or underneath any portion of the folds of the adjacent wipe(s). These configurations for wipes, as well as those discussed herein, may be provided by means known to those skilled in the art.

Alternatively, the individual wipes can be interfolded or in other ways related such that the leading and trailing end edges of successive wipes in the stacked configuration overlap, for "pop-up" dispensing. In such a configuration, the leading end edge of the trailing wipe is loosened from the stack by the trailing end edge of the leading wipe as the leading wipe is removed by the user. The wipes can be interfolded to facilitate such dispensing by means known to those skilled in the art.

Yet alternatively, the wipes can be arranged in the pouch as a continuous web of interconnected wipes which are folded in an accordion-like stacked configuration or a roll. The individual wipes can be connected together along lines of frangibility, such as lines of perforations, to ensure that the trailing wipe is in position for grasping by the user after the leading wipe is removed. For example, the wipes can be provided by a continuous web of material which has a series of lines of frangibility extending across the width of the web. The portion of the web of material between successive lines of frangibility provides each individual wipe. The lines of frangibility can be provided by means known to those skilled in the art such as perforations, indentations, or cuts in the web of material. For example, the lines of frangibility or perforations can be provided in the web of material by passing the web of material between a die cutter roll and anvil roll. After the lines of frangibility have been incorporated into the web of material, the web can then be arranged in a stacked configuration for easy insertion into the pouch during formation thereof.

The container of the present invention can include any suitable number of individual wipes depending upon the desired packaging and end use. For example, the container can be configured to include a stack of wipes which can include at least about 5 wipes and desirably from about 8 to about 320 individually wipes, and more desirably from about 16 to about 64 wipes. The size and shape of the stack of wipes is dependent upon the size and shape of the container and vice versa.

Each wipe is in particular embodiments generally rectangular in shape and defines a pair of opposite side edges and a pair of opposite end edges which can be referred to as a leading end edge and a trailing end edge. The leading end edge of each wet wipe is typically positioned in the pouch to be grasped by a user to facilitate a removal of the wipe from the container.

Materials suitable for the wipes of the present invention are well known to those skilled in the art. For wet wipes, these can be made from any material suitable for use as a moist wipe, including meltblown, coform, air-laid, bonded-carded web materials, hydroentangled materials, high wet-strength tissue and the like, and can comprise synthetic or natural fibers or combinations thereof. The wipes of the different aspects of the present invention can contain a liquid which can be any solution which can be absorbed into the wipes, thus making them "wet wipes." The liquid contained within the wet wipes can include any suitable components which provide the desired wiping properties.

As with the other packages of the invention, the pouch and/or rigid flip top can be transparent or translucent to provide an indication of the quantity of wipes remaining in the container. The pouch and/or rigid flip top can be made of various polymers, copolymers, and mixtures, including, e.g., polyethylene, polypropylene, polyester, polystyrene, and other polymers.

The different aspects and features of the present invention can in particular embodiments provide containers for wipes which, when compared to conventional containers for wipes, provide improved wipe dispensing. While the invention has been described in detail with respect to the specific aspects thereof, it will be appreciated that those skilled in the art, upon attaining an understanding of the foregoing, may readily conceive of alterations to, variations of, and equivalents to these aspects. Accordingly, the scope of the present invention should be assessed as that of the appended claims.

What is claimed is:

1. A storing and dispensing container for moist wipes, the container defining a length dimension, a width dimension, and a height dimension, the length dimension, width dimension, and height dimension all being perpendicular to each other, the container comprising:

a stack of moist wipes, the stack having a stack length that extends in the length dimension, a stack width that extends in the width dimension, and a stack height that extends in the height dimension, the stack having a stack top surface and a stack bottom surface spaced from one another in the height dimension, the stack having first and second end walls spaced from one another in the length dimension, the stack having first and second side walls spaced from one another in the width dimension;

a flexible film pouch surrounding the stack of moist wipes, the flexible film pouch having an inner surface generally facing the stack of moist wipes, and an opposing outer surface, the flexible film pouch defining a dispensing orifice; and a rigid flip top comprising a lid connected to a flange by a hinge, wherein the flange is affixed to the outer surface of the pouch, wherein the flange surrounds the dispensing orifice, the flange able to assume a bent state and an unbent state, wherein when in the unbent state the flange defines a flange length that extends in the length dimension and a flange width that extends in the width dimension, wherein the flange length and the flange width together define a flange plane, wherein the flange plane is generally parallel to the stack top surface, wherein the flange length is less than 80 percent of the stack length, and wherein the flange width is less than 80 percent of the stack width, the flange having a first hinge and a second hinge that each extend along a first bending axis, such than when a top wipe is extracted from the package through the dispensing orifice, the first bending axis is pulled away from the stack, and the flange bends about the first bending axis to assume the bent state, wherein the flexible film pouch is substantially moisture impervious other than the presence of the dispensing orifice, and wherein the first hinge is defined by a first area of reduced flange rigidity, and wherein the second hinge is defined by a second area of reduced flange rigidity.

2. The container of claim 1, wherein the flange has a third hinge and a fourth hinge that each extend along a second bending axis, such that when a wipe is extracted from the package through the dispensing orifice, the second bending axis is pulled away from the stack, and the flange bends about the second bending axis.

3. The container of claim 2, wherein the first bending axis forms an angle of 90 degrees with the second bending axis.

4. The container of claim 2, wherein the first bending axis forms an angle of between 10 and 45 degrees with the second bending axis.

5. The container of claim 2, wherein the first bending axis is parallel to the second bending axis.

6. The container of claim 1, wherein the flexible film pouch defines first and second side wall portions that face the first and second stack side walls respectively, wherein the stack of moist wipes prevents the first and second side wall portions from collapsing toward one another by more than 10 percent of the stack width when the flange bends about the first bending axis during extraction of the top wipe.

7. The container of claim 1, wherein the flexible film pouch includes a removable portion that can be removed to form the dispensing orifice.

8. The container of claim 1, wherein the flange includes a plurality of strengthening ribs, and wherein the first hinge is defined by a first gap in the ribs, and wherein the second hinge is defined by a second gap in the ribs.

9. The container of claim 8, wherein the first hinge is further defined by a first area of reduced flange thickness, and wherein the second hinge is further defined by a second area of reduced flange thickness.

10. The container of claim 1, wherein the first hinge is defined by a first area of reduced flange thickness, and wherein the second hinge is defined by a second area of reduced flange thickness.

11. The container of claim 1, wherein the first hinge is defined by a first area of reduced flange width, and wherein the second hinge is defined by a second area of reduced flange width.

12. The container of claim 1, where the flange comprises a plurality of distinct, non-integrally connected rigid thermoplastic portions joined together by one or more thermoplastic elastomer segments, such that each hinge in the flange comprises thermoplastic elastomer material but each hinge does not comprise rigid thermoplastic material.

13. A storing and dispensing container for moist wipes, the container defining a length dimension, a width dimension, and a height dimension, the length dimension, width dimension, and height dimension all being perpendicular to each other, the container comprising:

a stack of moist wipes, the stack having a stack length that extends in the length dimension, a stack width that extends in the width dimension, and a stack height that extends in the height dimension, the stack having a stack top surface and a stack bottom surface spaced from one another in the height dimension, the stack having first and second end walls spaced from one another in the length dimension, the stack having first and second side walls spaced from one another in the width dimension;

a flexible film pouch surrounding the stack of moist wipes, the flexible film pouch having an inner surface generally facing the stack of moist wipes, and an opposing outer surface, the flexible film pouch defining a dispensing orifice; and a rigid flip top comprising a lid connected to a flange by a hinge, wherein the flange is affixed to the outer surface of the pouch, wherein the flange surrounds the dispensing orifice, the flange able to assume a bent state and an unbent state, wherein when in the unbent state the flange defines a flange length that extends in the length dimension and a flange width that extends in the width dimension, wherein the flange length and the flange width together define a flange plane, wherein the flange plane is generally parallel to the stack top surface, wherein the flange length is less than 80 percent of the stack length, and wherein the flange width is less than 80 percent of the stack width, the flange having a first hinge and a second hinge that each extend along a first bending axis, such than when a top wipe is extracted from the package through the dispensing orifice, the first bending axis is pulled away from the stack, and the flange bends about the first bending axis to assume the bent state, wherein the flexible film pouch is substantially moisture impervious other than the presence of the dispensing orifice, wherein the flexible film pouch defines first and second side wall portions that face the first and second stack side walls respectively, wherein the stack of moist wipes prevents the first and second side wall portions from collapsing toward one another by more than 10 percent of the stack width when the flange bends about the first bending axis during extraction of the top wipe, wherein the flexible film pouch includes a removable portion that can be removed to form the dispensing orifice, wherein the flange includes a plurality of strengthening ribs, and wherein the first hinge is at least partially defined by a first gap in the ribs, and wherein the second hinge is at least partially defined by a second gap in the ribs, wherein the first hinge is further at least partially defined by a first area of reduced flange thickness, and wherein the second hinge is further at least partially defined by a second area of reduced flange thickness.

14. The container of claim 13, wherein the flange has a third hinge and a fourth hinge that each extend along a second bending axis, such that when a wipe is extracted from the package through the dispensing orifice, the second bending axis is pulled away from the stack, and the flange bends about the second bending axis.

* * * * *